US006382333B1

(12) United States Patent
Murray

(10) Patent No.: US 6,382,333 B1
(45) Date of Patent: May 7, 2002

(54) FRICTION REDUCING TOOL FOR OILFIELD DRILLING APPLICATIONS

(75) Inventor: Geoffrey Neil Murray, New Plymouth (NZ)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/380,940

(22) PCT Filed: Mar. 11, 1998

(86) PCT No.: PCT/NZ98/00032

§ 371 Date: Nov. 1, 1999

§ 102(e) Date: Nov. 1, 1999

(87) PCT Pub. No.: WO98/40601

PCT Pub. Date: Sep. 17, 1998

(30) Foreign Application Priority Data

Mar. 11, 1997 (NZ) ..... 314387

(51) Int. Cl.[7] ..... E21B 17/10
(52) U.S. Cl. ..... 175/325.3; 166/241.3
(58) Field of Search ..... 175/325.3; 166/241.3

(56) References Cited

U.S. PATENT DOCUMENTS

| | | | | |
|---|---|---|---|---|
| 1,651,088 A | | 11/1927 | Fentress | |
| 1,699,087 A | | 1/1929 | Woodmansee et al. | |
| 1,801,294 A | * | 4/1931 | Sutton | 166/241.3 |
| 1,831,999 A | | 11/1931 | Bull | |
| 1,913,365 A | | 6/1933 | Bailey | |
| 1,923,328 A | * | 8/1933 | Reed | 175/325.3 |
| 2,601,478 A | * | 6/1952 | Weir | 166/241.3 |
| 2,812,200 A | * | 11/1957 | Yeargan | 166/241.7 |
| 3,052,310 A | | 6/1962 | Kinzbach | |
| 3,797,592 A | | 3/1974 | Goodfellow | 175/325 |
| 4,013,325 A | | 3/1977 | Rear | 308/4 A |
| 4,548,284 A | * | 10/1985 | Shinn et al. | 175/346 |
| 4,583,604 A | * | 4/1986 | Greer | 175/346 |
| 4,919,205 A | | 4/1990 | Dollison | 166/241 |
| 4,958,692 A | * | 9/1990 | Anderson | 175/323 |
| 5,186,264 A | | 2/1993 | duChafaut | 175/27 |
| 5,692,562 A | * | 12/1997 | Squires | 166/68.5 |
| 5,778,976 A | | 7/1998 | Murray | 166/241.6 |

FOREIGN PATENT DOCUMENTS

| | | |
|---|---|---|
| AU | PCT/AU96/00525 | 3/1997 |
| GB | 2 233 690 A | 1/1991 |
| GB | 2 257 447 A | 1/1993 |
| GB | PCT/GB94/02236 | 4/1995 |
| RU | 2012769 | 5/1994 |
| WO | WO 93/24728 | 12/1993 |
| WO | WO 95/05521 | 2/1995 |
| WO | WO 95/11368 | 4/1995 |
| WO | WO 95/21986 | 8/1995 |
| WO | WO 96/34173 | 10/1996 |

OTHER PUBLICATIONS

Int'l Search Report in PCT/N298/00032, Jun. 12, 1998.
Int'l Preliminary Examination Report in PCT/N298/00032, May 10, 1999.
Written Opinion in PCT/N298/00032, Feb. 25, 1999.
Written Opinion in PCT/N298/00032, Oct. 14, 1998.

* cited by examiner

*Primary Examiner*—Hoang Dang
(74) *Attorney, Agent, or Firm*—Moser, Patterson & Sheridan, L.L.P.

(57) ABSTRACT

A friction reducing tool for drilling applications having a plurality of rollers for about the periphery of the tool (3). The rollers (4) have extensions (7) which locate within cavities (8) to prevent the rollers from passing from cavity (10) to the exterior of the tool. The tool is formed in multiple parts (3*a* and 3*b*) having interengaging tongues (5 and 6) which are joined together by passing a rod (15) through bore (13). A groove (14) is provided in outer component (2) to enable rod (15) to be inserted in bore (13).

18 Claims, 6 Drawing Sheets

FRICTION REDUCING TOOL FOR OILFIELD DRILLING APPLICATIONS

TECHNICAL FIELD

The present invention relates to a friction reducing tool suitable for use in drilling applications. In one aspect the present invention relates to a tool having a multipart rotatable outer component wherein the parts may be secured together by rods insertable through a groove in the main body part of the drill string component and a tool incorporating rollers having positive roller containment.

BACKGROUND OF THE INVENTION

It is known in the industry to provide a tool in which an outer rotatable portion is formed in multiple parts, which are secured together about the tool. Typically, a recess is provided in the main body portion of the tool and the multiple parts are secured about the main body portion within the recess so as to be rotatable thereabout. Typically, the multiple portions are fastened together by bolts or other similar fastening means. Often this requires projecting flanges which may cause obstruction. Further, under extreme loads the multiple portions could separate, leaving parts of the tool obstructing a well.

It is also known to provide rollers about the periphery of a tool to minimise friction. Typically, such rollers are inserted into a cavity in the tool from the exterior and a pin is inserted to secure the roller in place. Under severe load conditions the pin can shear and the roller and pin may drop out of the tool and obstruct the well.

DISCLOSURE OF THE INVENTION

It is an object of the present invention to overcome these problems or at least to provide the public with a useful choice.

According to a first aspect of the invention there is provided a friction reducing tool for drilling applications comprising a generally tubular body portion having a cavity in a side wall thereof which accommodates a roller, wherein the cavity is dimensioned so that the roller can be introduced into the cavity from the interior of the body portion but cannot pass out of the cavity to the exterior of the body portion.

According to a further aspect of the invention there is provided a friction reducing tool having an inner component securable to or about a drill string and an outer component rotatable about the inner component, wherein the outer component is formed in multiple parts secured together by rods and is located within an annular recess in the inner component and wherein a groove is provided in the inner component adjacent the recess to enable a rod to be inserted when the parts of the outer component are assembled about the recess.

The groove is preferably angled downwardly towards the recess so that the rod deflects as it is inserted into apertures in the parts and, when in place, abuts against thrust faces of the drill string component.

According to a further aspect there is provided a friction reducing tool comprising a plastic sleeve for securement about a drill pipe, first and second collars to secure the plastic sleeve to a drill pipe at either end thereof and an outer component for securement about the plastic sleeve between the collars, wherein the outer component is provided with a plurality of friction reducing rollers about the periphery thereof.

BRIEF DESCRIPTION OF THE DRAWINGS

The invention will now be described by way of example with reference to the accompanying drawings in which.

BEST MODE FOR CARRYING OUT THE INVENTION

Referring firstly to FIGS. 1 to 5 there is shown a friction reducing tool 1 comprising an inner component 2 and a rotatable outer component 3. Outer component 3 includes a plastic bearing 3*c* and is rotatable with respect to inner component 2 to reduce rotational friction.

Figure 7:
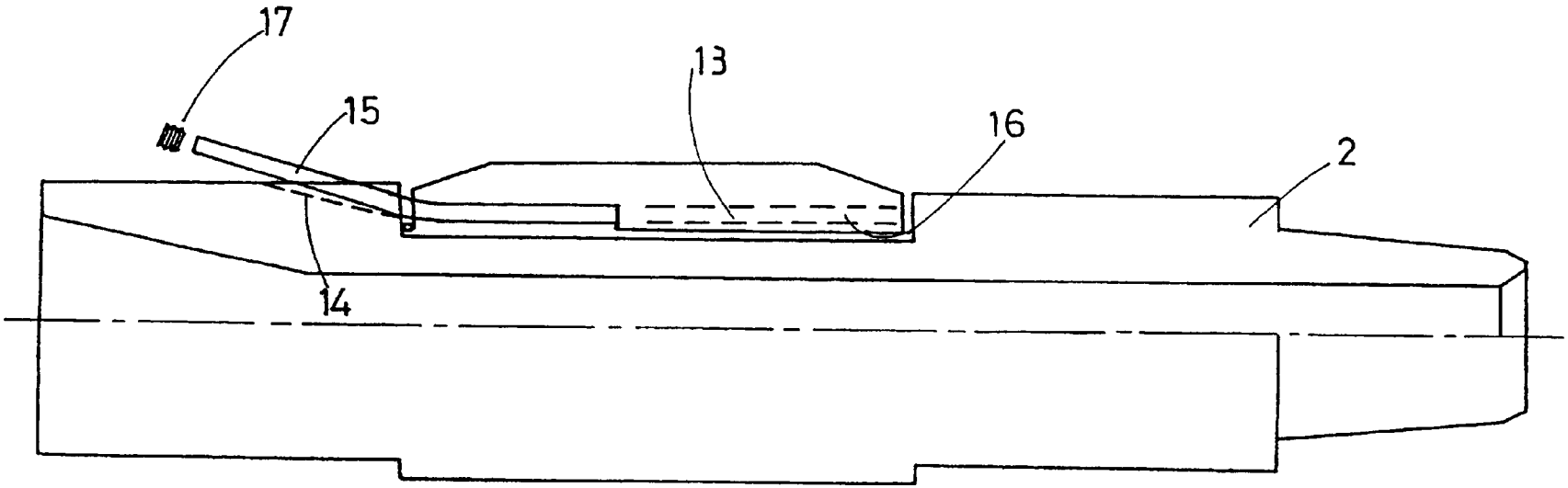
FIG. 7: shows a perspective view of the groove which guides the rod during the insertion operation shown in FIG. 6.

A plurality of rollers 4 are provided in three banks about the periphery of rotatable component 3 within cavities 10 to reduce axial drag. Outer rotatable component 3 is divided into two parts 3*a* and 3*b* which, during assembly, are inter-engaged about inner component 2 within recess 16 (see FIG. 7) and secured in place by rods 15 passing through apertures in inter-engaging tongue portions 5 and 6.

Figure 2:
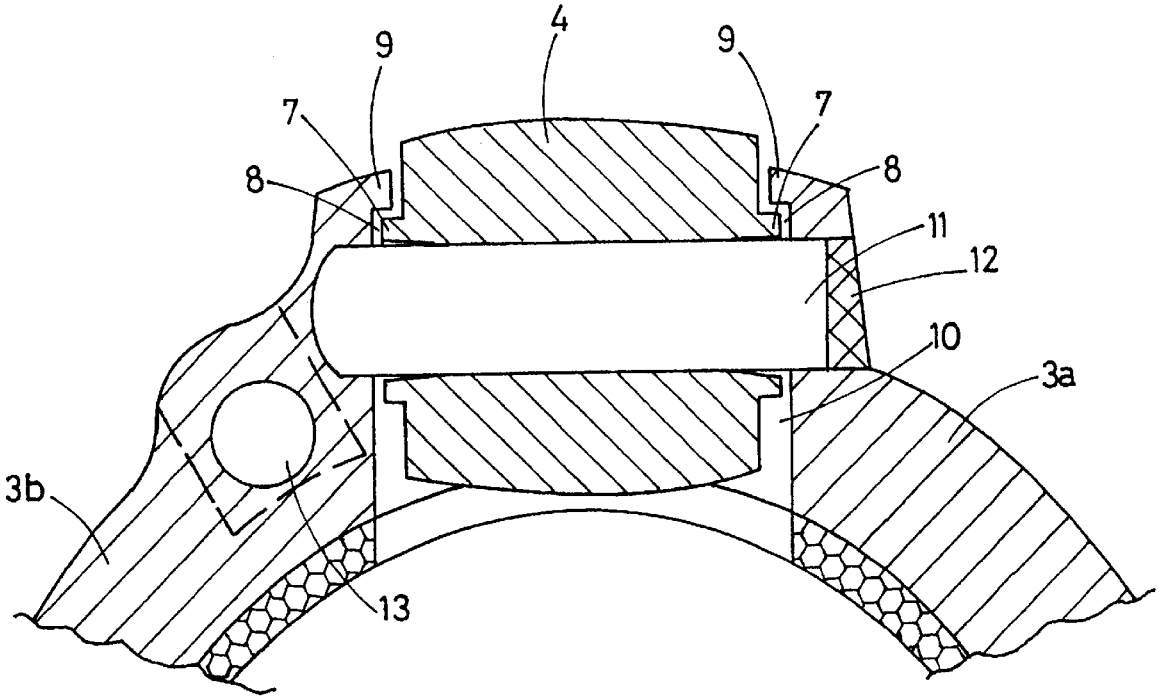
FIG. 2: shows a partial cross-sectional view of the outer component shown in FIG. 1.
Figure 3:
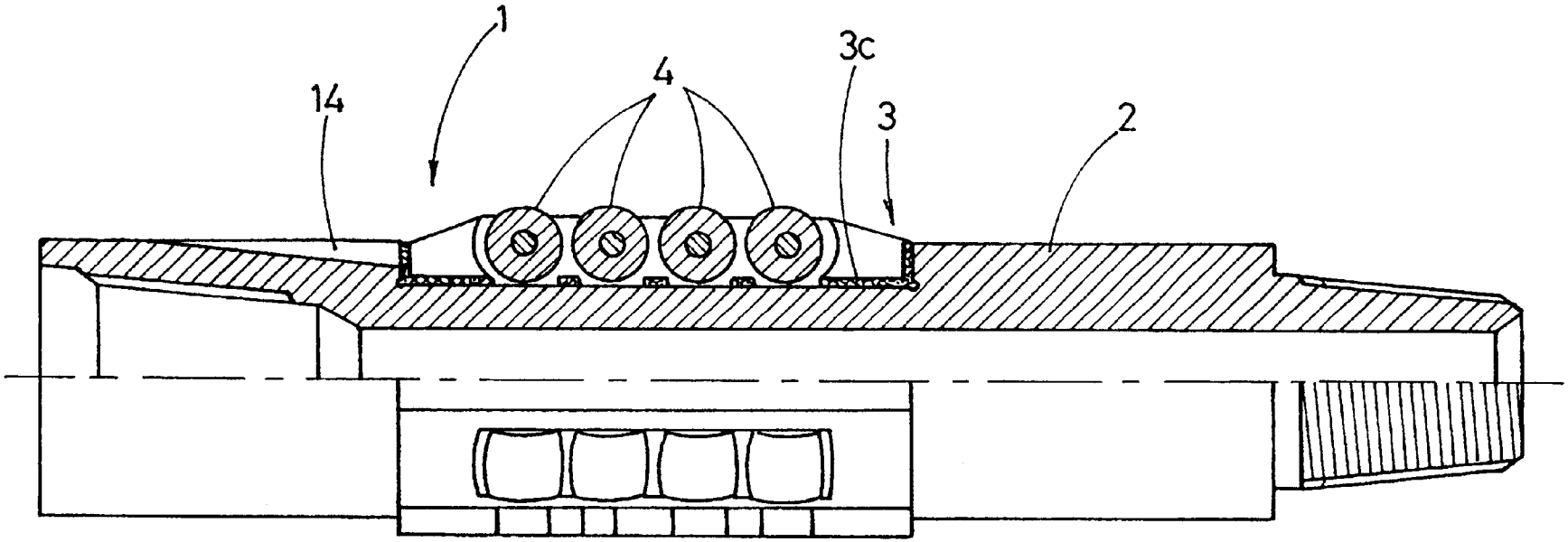
FIG. 3: shows a partial cross-sectional view along the axis of the tool.
Figure 4:
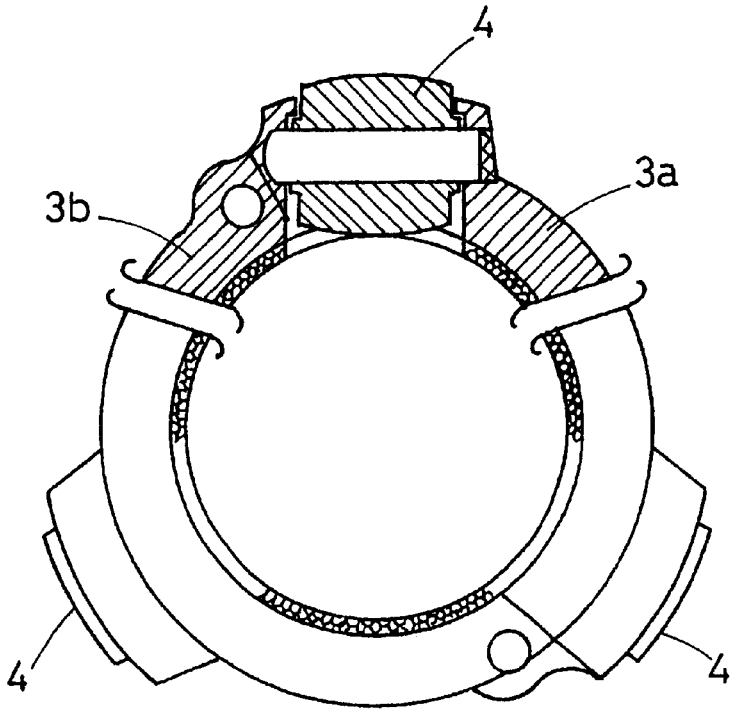
FIG. 4: shows a partial cross-sectional view of the outer component.
Figure 5:
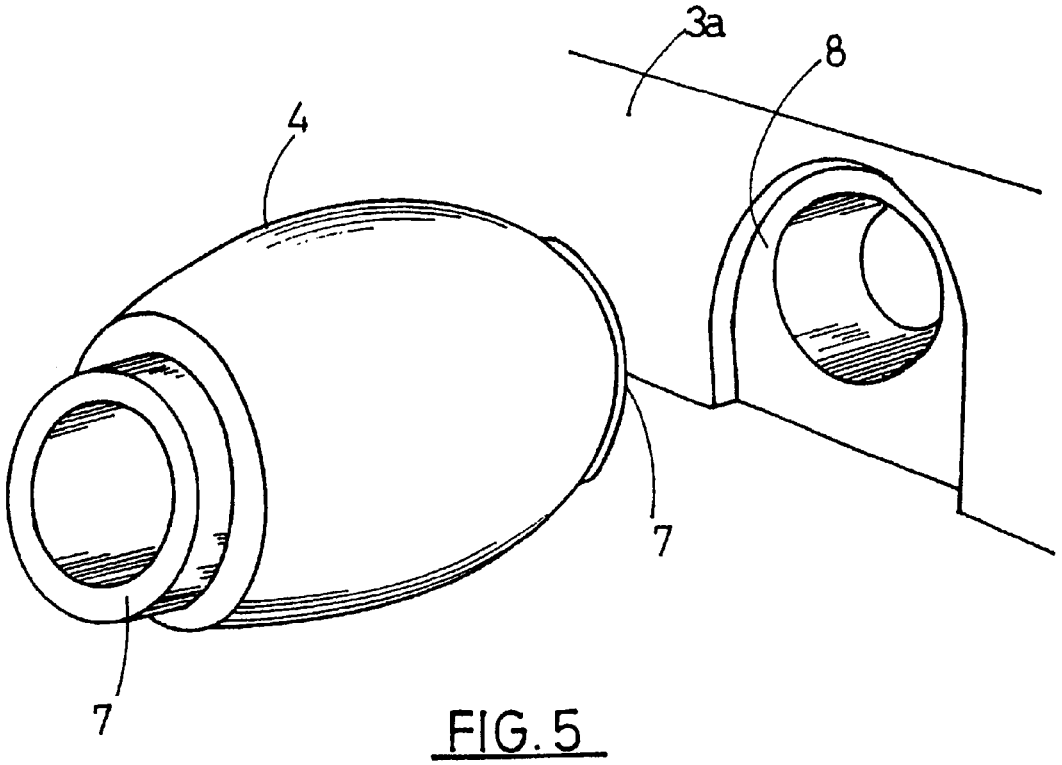
FIG. 5: shows an exploded view of a roller and roller cavity.
Figure 6:
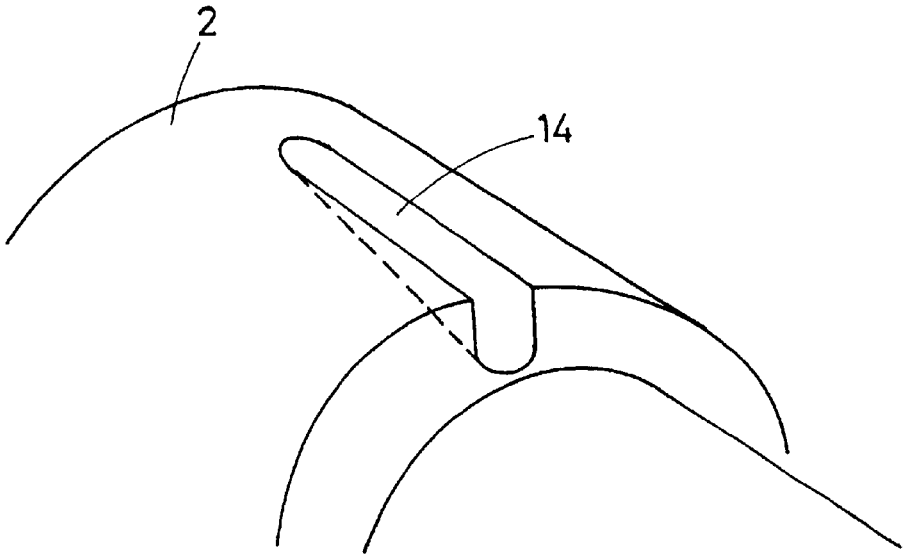
FIG. 6: shows insertion of a rod to secure the parts of an outer component together.

Each roller 4 is provided with extensions 7 at each end, which, in use, are located within a respective cavity 8. Overhangs 9 prevent roller 4 from leaving cavity 10 should axle 11 shear under high load conditions. As shown in FIG. 2 the diameter of the bore through roller 4 increases towards the ends of the roller to reduce sheer forces on axle 11 at the ends of the roller.

To assemble the banks of rollers each roller must be inserted from the interior of outer section 3 and when extensions 7 are located within cavity 8, pin 11 is inserted to secure each roller in place. Pin 11 may be secured in place by welding 12 or other suitable means.

Figure 1:
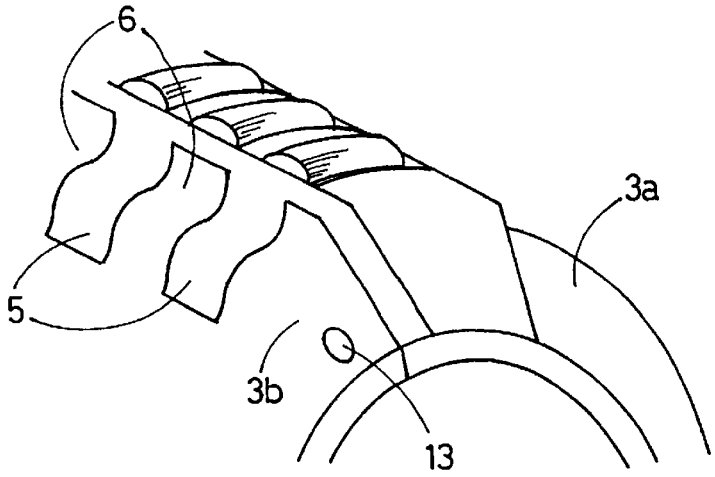
FIG. 1: shows a partial perspective view of an outer component of a friction reducing tool.

From FIG. 1 it will be seen that outer part 3*a* includes tongues 5 which inter-engage with tongues 6 of outer part 3*b*. A rod is first passed through apertures in interengaged tongues of outer parts 3*a* and 3*b* to join the halves together in a hinged manner. The hinged assembly is then placed within recess 16 and tongues 5 and 6 brought into engagement (as shown in FIG. 1). Outer parts 3*a* and 3*b* are secured together by placing a rod through aperture 13.

It is important that no part of the drill string component is released to obstruct a well. There is thus provided a groove 14 to facilitate insertion of rod 15 to secure parts 3*a* and 3*b* together (see FIG. 7). As shown diagrammatically in FIG. 7 parts 3*a* and 3*b* are interengaged within recess 16 of body portion 2 with aperture 13 aligned with groove 14. Rod 15 is then guided by groove 14 into aperture 13 to secure parts 3*a* and 3*b* together. Once the rod 15 is inserted a grub screw 17 may be inserted to retain pin 15 in place. As is shown diagrammatically in FIG. 7 rod 15 is deflected as it is inserted within aperture 13 so that it would be extremely difficult for rod 15 to dislodge. Further, as it would be rare for rod 15 to be aligned with groove 14, the chance of rod 15 separating is further minimised.

Preferably groove 14 is provided in the top end of body portion 2 so that rod 15 will not be forced against groove 14 by the force of gravity. The drill string component is preferably formed of steel although the rollers 4 could be formed of suitable plastics materials.

Figure 8:
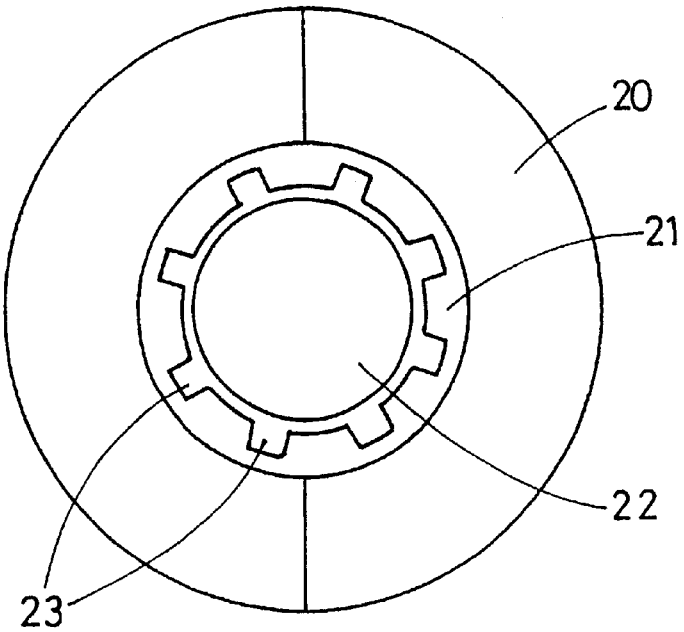
FIG. 8: shows an embodiment incorporating a plastics bearing having longitudinal channels.

Referring to FIG. 8 an embodiment incorporating a thermoplastics bearing 21 between an outer section 20 and a main body portion 22 is shown conceptually in cross section. The thermoplastics bearing 21 incorporates rectangular channels 23 to facilitate lubrication.

Figure 9:
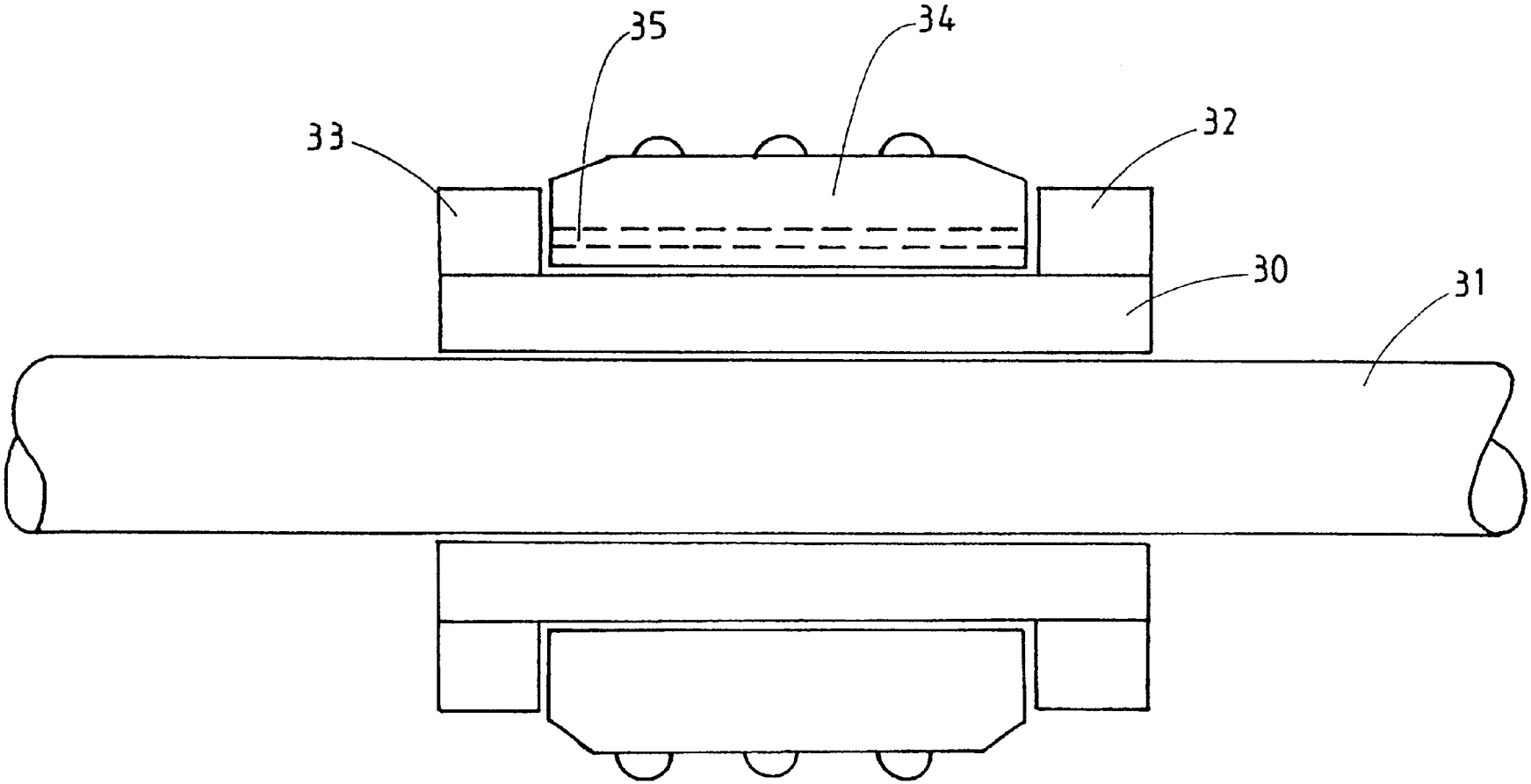
FIG. 9: shows a further embodiment incorporating a plastics sleeve.

Referring now to FIG. 9 there is shown an alternative embodiment in which a plastics sleeve 30 is secured directly to drill string 31 by stop collars 32 and 33. Outer section 34 is of the same construction as outer section 3 described above and is secured about plastics sleeve 30.

The interior surface of outer component 34 is preferably hard faced and precision ground to reduce friction between outer component 34 and plastics sleeve 30.

In use plastics sleeve 30 may be slid over one end of drill pipe 31. Alternatively, where a hinged or multi-part sleeve is employed, the sleeve may be placed about drill pipe 31. A first collar 32 may then be secured about sleeve 30 at one end thereof. The collars may be of single or multipart construction. Outer component 34 may then be placed about plastics sleeve 30 and a rod inserted within bore 35 to secure the parts together (as previously described). Stop collar 33 may then be secured about the other end of plastics sleeve 30 to secure plastics sleeve 30 to drill pipe 31 and retain outer component 34 between stop collars 32 and 33.

Although this invention has been described in relation to a component for use with a drill string it will be appreciated that the principles of the invention may be applied to a component for installing casing or in other drilling applications.

It will be appreciated that the present invention provides an arrangement for mounting rollers which minimises the likelihood of parts of a drill string component obstructing a well. Further, the invention provides a means of reliably securing together multipart outer components which provides strength and minimises the risk of components obstructing a well.

Where in the foregoing description reference has been made to integers or components having known equivalents then such equivalents are herein incorporated as if individually set forth.

Although this invention has been described by way of example it is to be appreciated that improvements and/or modifications may be made thereto without departing from the scope of the invention as defined in the appended claims.

What is claimed is:

1. A friction reducing tool for drilling applications comprising a generally tubular body portion having a cavity in a side wall thereof which accommodates a roller secured by an axle, wherein the roller is provided with projections in the form of tubular extensions at either end of the roller, and the roller and the cavity are dimensioned so that, should the axle break, the roller cannot pass out of the cavity to the exterior of the body portion.

2. The tool of claim 1, wherein the projections at either end thereof are located within overhang portions of the body portion.

3. The tool of claim 1, wherein the overhang portions are substantially complementary to the shape of the projections.

4. The tool of claim 1, wherein the roler has a bore therethrough to accommodate the axle, the diameter of the bore increasing towards the outer ends thereof to reduce shear forces on the axle.

5. The tool of claim 1, wherein a plurality of cavities are provided about the periphery of the tool.

6. The tool of claim 1, wherein a plurality of rollers are provided in each cavity.

7. A friction reducing tool for drilling applications comprising a generally tubular body portion having a cavity in a side wall thereof which accommodates a roller secured by an axle, wherein the roller and the cavity are dimensioned so that should the axle break the roller cannot pass out of the cavity to the exterior of the body portion, an inner component securable to or about an oil field tubular with said body portion being rotatable about the inner component in use, wherein the body portion is formed in multiple parts secured together by rods and is located within an annular recess in the inner component, and wherein a groove is provided in the inner component adjacent the recess to enable a rod to be inserted whilst parts of the body portion are assembled about the recess.

8. The tool as claimed in claim 7, wherein the groove is inclined downwardly from one end of the inner component to the recess.

9. The tool as claimed in claim 7, wherein each part of the body portion is provided with interengaging tongues so that the parts may be joined in a hinged manner.

10. The tool as claimed in claim 7, wherein the body portion is formed in two parts.

11. The tool as claimed in claim 7, wherein a plastics sleeve is provided between the inner component and the body portion.

12. The tool as claimed in claim 7, wherein the inner component is a sub-assembly having couplings for engagement to sections of a drill pipe.

13. A friction reducing tool for use in a wellbore, comprising:

a tubular body portion having a cavity in a side wall thereof;

one or more rollers having projections at either end thereof, wherein the one or more rollers are secured to the cavity using an axle, and wherein the one or more rollers and the cavity are dimensioned so that should the axle break, the roller cannot pass out of the cavity to the exterior of the body portion;

a plastic sleeve for securement about an oil field tubular; and first and second collars to secure the plastics sleeve to the oil field tubular at either end thereof, wherein the body portion is securable about the plastics sleeve between the collars in use.

14. The tool as claimed in claim 13, wherein the body portion is formed in a plurality of parts which is secured together by rods passing through apertures in interengaging faces of the parts.

15. The tool as claimed in claim 14, wherein the interior faces of the parts are hard faced and ground.

16. A method of assembling a friction reducing tool about an oil field tubular, wherein the friction reducing tool comprises a generally tubular body portion having a cavity in a side wall thereof which accommodates a roller secured by an axle, wherein the roller and the cavity are dimensioned so that should the axle break the roller cannot pass out of the cavity to the exterior of the body portion, a plastics sleeve for securement about the oil field tubular and, first and second collars to secure the plastics sleeve to the oil field tubular at either end thereof wherein the body portion is securable about the plastics sleeve between the collars in use, the method comprising:

i. placing the plastics sleeve about the oil field tubular;

ii. securing the first collar about one end of the plastics sleeve;

iii. positioning the body portion about the plastics sleeve, wherein the body portion is formed from a plurality of parts secured together by inserting a rod through apertures in interengaging faces of the parts; and iv. securing the second collar about the other end of the plastics sleeve to retain the body portion about the plastics sleeve between the collars.

17. A friction reducing tool for drilling applications comprising a generally tubular body portion having a cavity in a side wall thereof which accommodates a roller secured by an axle, wherein the roller has a bore therethrough to accommodate the axle, the diameter of the bore increasing towards the outer ends thereof, and wherein the roller and the cavity are dimensioned so that should the axle break, the roller cannot pass out of the cavity to the exterior of the body portion.

18. A friction reducing tool for drilling applications comprising a generally tubular body portion having a cavity in a side wall thereof which accommodates a roller secured by an axle, wherein the roller and the cavity are dimensioned so that should the axle break the roller cannot pass out of the cavity to the exterior of the body portion, an inner component securable to or about an oil field tubular with said body portion being rotatable about the inner component in use, wherein the body portion is formed in multiple parts secured together by rods and is located within an annular recess in the inner component, and wherein a groove is provided in the inner component adjacent the recess to enable a rod to be inserted whilst parts of the body portion are assembled about the recess, the groove is inclined downwardly from one end of the inner component to the recess.

* * * * *